United States Patent [19]

Baxter

[11] Patent Number: 4,537,450

[45] Date of Patent: Aug. 27, 1985

[54] THREE PART SLIDE

[75] Inventor: Alan R. Baxter, Hamilton, Canada

[73] Assignee: Jacmorr Manufacturing Limited, Kitchener, Canada

[21] Appl. No.: 494,622

[22] Filed: May 16, 1983

Related U.S. Application Data

[62] Division of Ser. No. 229,980, Jan. 30, 1981, abandoned.

[30] Foreign Application Priority Data

Nov. 7, 1979 [CA] Canada ..... 339355

[51] Int. Cl.[3] ..... F16C 29/04

[52] U.S. Cl. ..... 308/3.8

[58] Field of Search ..... 308/3.8, 3.6, 6 R; 312/333, 334, 339, 341 R, 348

[56] References Cited

U.S. PATENT DOCUMENTS

| | | | |
|---|---|---|---|
| 3,904,254 | 9/1975 | Hagen et al. | 308/3.8 |
| 4,037,885 | 7/1977 | Rock et al. | 308/3.8 |
| 4,065,196 | 12/1977 | Stein | 312/341 R |
| 4,119,377 | 10/1978 | Barber et al. | 312/341 R |
| 4,183,596 | 1/1980 | Greene et al. | 312/334 |

*Primary Examiner*—Lenard A. Footland

*Attorney, Agent, or Firm*—Ridout & Maybee

[57] ABSTRACT

Three part slide with latching between the intermediate and inner rails in the retracted condition and latching between the intermediate and outer rails in the extended condition whereby first the outer rail moves relative to the other two, following which the inner rail moves relative to the other two.

12 Claims, 20 Drawing Figures

10
11
12
13
14
16
17
18
19
24
26
27
28
29
31
32
33
34
A

XIX
XIX
IX
13
14
16
17
18
19
21
22
23
24
26
27
29
31
32
33
34
36
37
38
41

THREE PART SLIDE

This application is a division of application Ser. No. 229,980, filed Jan. 30, 1981, now abandoned.

BRIEF SUMMARY OF THE INVENTION

The present invention relates to a three-part drawer slide having outer, intermediate, and inner rails, and bearings permitting relative travel or extension between the outer and intermediate rails and between the inner and intermediate rails.

With such slides there is a problem of unevenness of travel of the slide parts when used as supports on opposite sides of a drawer in a piece of furniture, an office filing drawer assembly, or any other form of cabinet. Unless the movements of the rails on opposite sides are synchronized during opening and closing movements, there is a tendency for the moving rails to come momentarily to rest at random positions on opposite sides of the drawer as a result of the intermediate or inner rail reaching a stop limiting its travel, and these random checks or interruptions in the movement of the rails result in an unevenness of operation that is transmitted to the drawer as a lateral swaying motion. This makes for roughness of operation of the slides especially if the maximum extents of travel between the intermediate and outer rail is different from the maximum travel of the inner rail relative to the intermediate rail and results in increased wear, thus reducing the service life of the slides. Known slides have rigid links, or equalizing cables between the slides on opposite sides of the drawer, or include frictional wheels intended to synchronize the movement of the parts, but these are prone to rapid wear and are vulnerable to damage, and may be difficult to accommodate or unesthetic in a particular style of cabinet.

The present invention provides a three-part drawer slide comprising outer, intermediate, and inner rails, bearings between the rails for reduced friction sliding movement of the outer rail relative to the intermediate rail and of the intermediate rail relative to the inner rail, stop means defining a retracted condition of said rails relative to one another and an extended position of said rails relative to one another, first latching means for releasably latching together the intermediate and inner rails in a retracted condition of the latter relative to the former, and second latching means for releasably latching the intermediate and outer rails together in relatively extended position of the intermediate rail relative to the outer rail, and release means responsive to movement of the intermediate rail relative to the outer rail and operative to release the first latching means when the intermediate rail reaches its extended position relative to the outer rail.

It will be appreciated that the designations "inner rail" and "outer rail" are employed purely for convenience of description, and that the inner rail may lie adjacent the drawer or the cabinet, and the same for the outer rail.

With this arrangement, the intermediate rail is latched stationarily relative to the inner rail and in the initial opening movement only the outer rail moves relative to the other two rails up to a certain extent of opening or extension movement of the slide, beyond which point the intermediate rail is latched stationarily to the outer rail and only the inner rail moves relative to the other two. In this way, the movement of the rails on opposite sides of the drawer is synchronized because the extent of opening of the drawer determines which of the rails is free to move and at all times only one rail is free to move.

BRIEF DESCRIPTION OF THE SEVERAL VIEWS OF THE DRAWINGS

An example is illustrated in the accompanying drawings wherein.

DETAILED DESCRIPTION

Figures 1, 2, 2A:
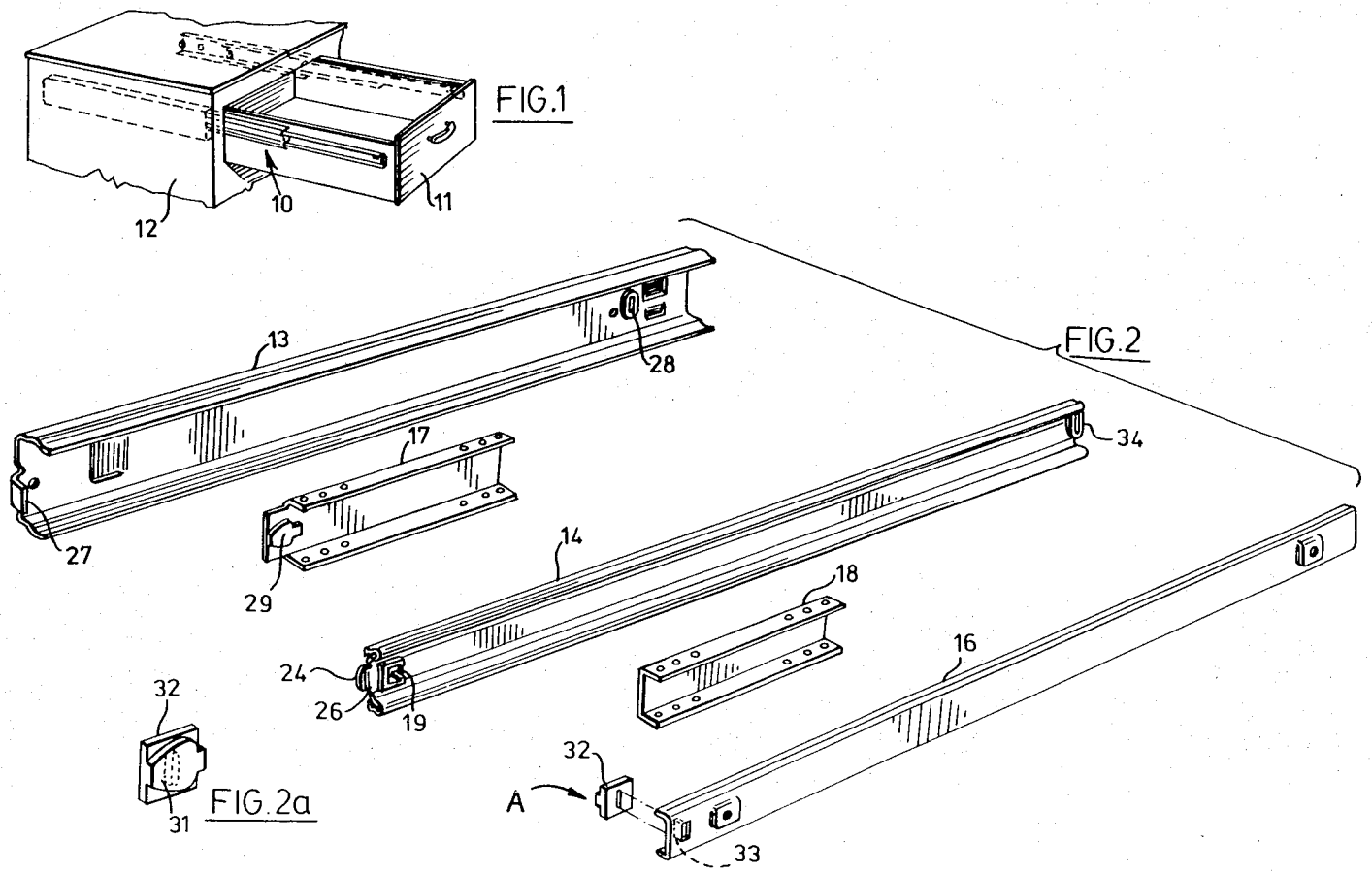
FIG. 1 is a perspective view of a three part slide in use in a cabinet.
FIG. 2 is an exploded perspective view of a first form of slide in accordance with the invention.
FIG. 2*a* shows a detailed view of the engagement member, taken on the arrow A in FIG. 2.

Referring to the drawings wherein like reference numerals indicate like parts, in FIG. 1 a slide 10 is connected on each side of a drawer 11 mounted in a cabinet 12. The slide comprises outer, intermediate, and inner channel section rails 13, 14 and 16, the channel-section ball bearing cages 17 and 18 interposed therebetween.

Figures 3, 4, 5, 6, 7:
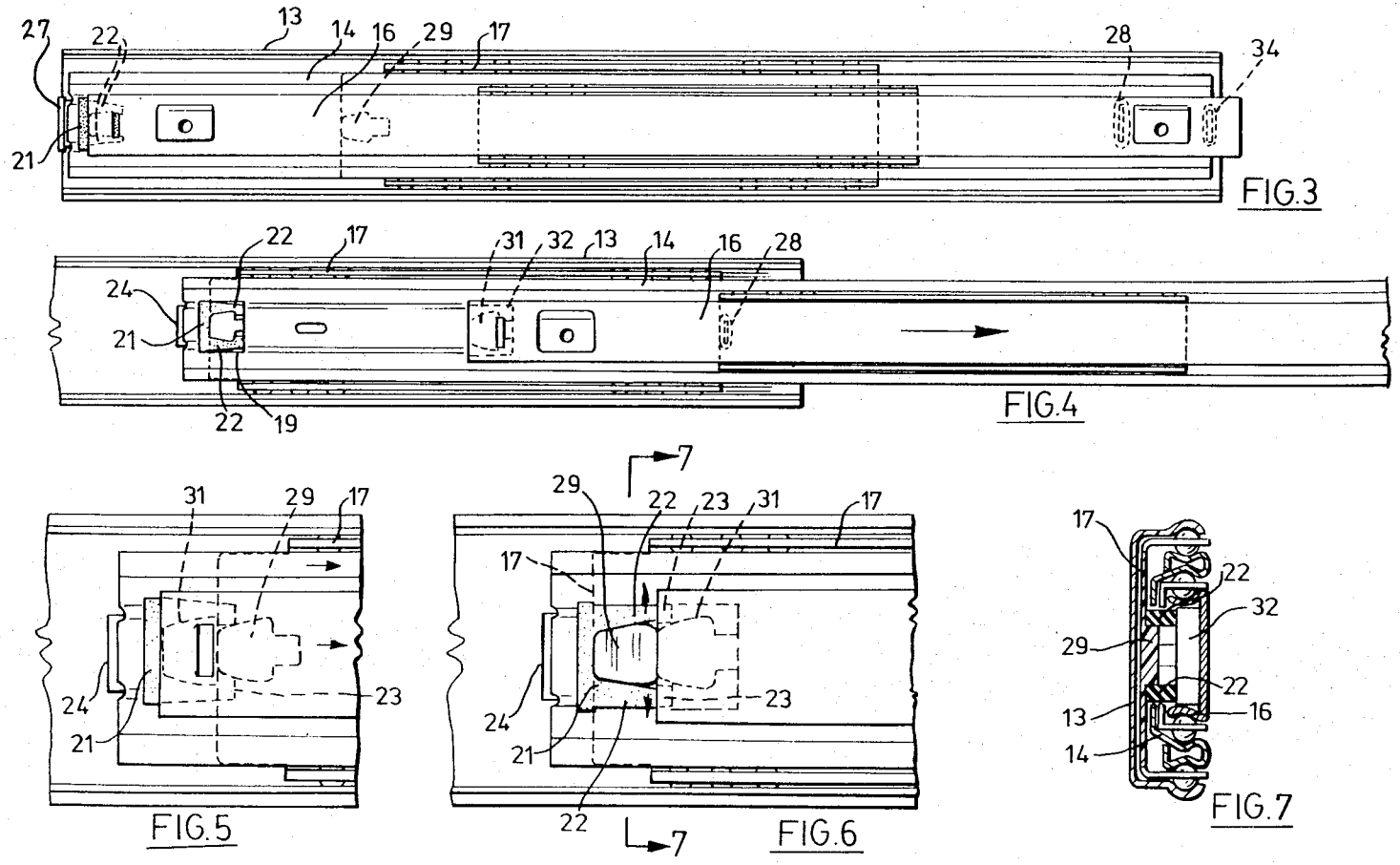
FIG. 3 is an elevational view from the inner side of the slide of FIG. 2.
FIG. 4 is a view similar to FIG. 3 illustrating the slide in extended position.
FIG. 5 is an enlarged view of the inner end of the intermediate channel rail of the slide of FIG. 2, illustrating the latching means.
FIG. 6 is a view corresponding to FIG. 5 at a later stage of extension of the slide.
FIG. 7 is a view taken on the lines 7—7 in FIG. 6.
Figures 8, 9, 10:
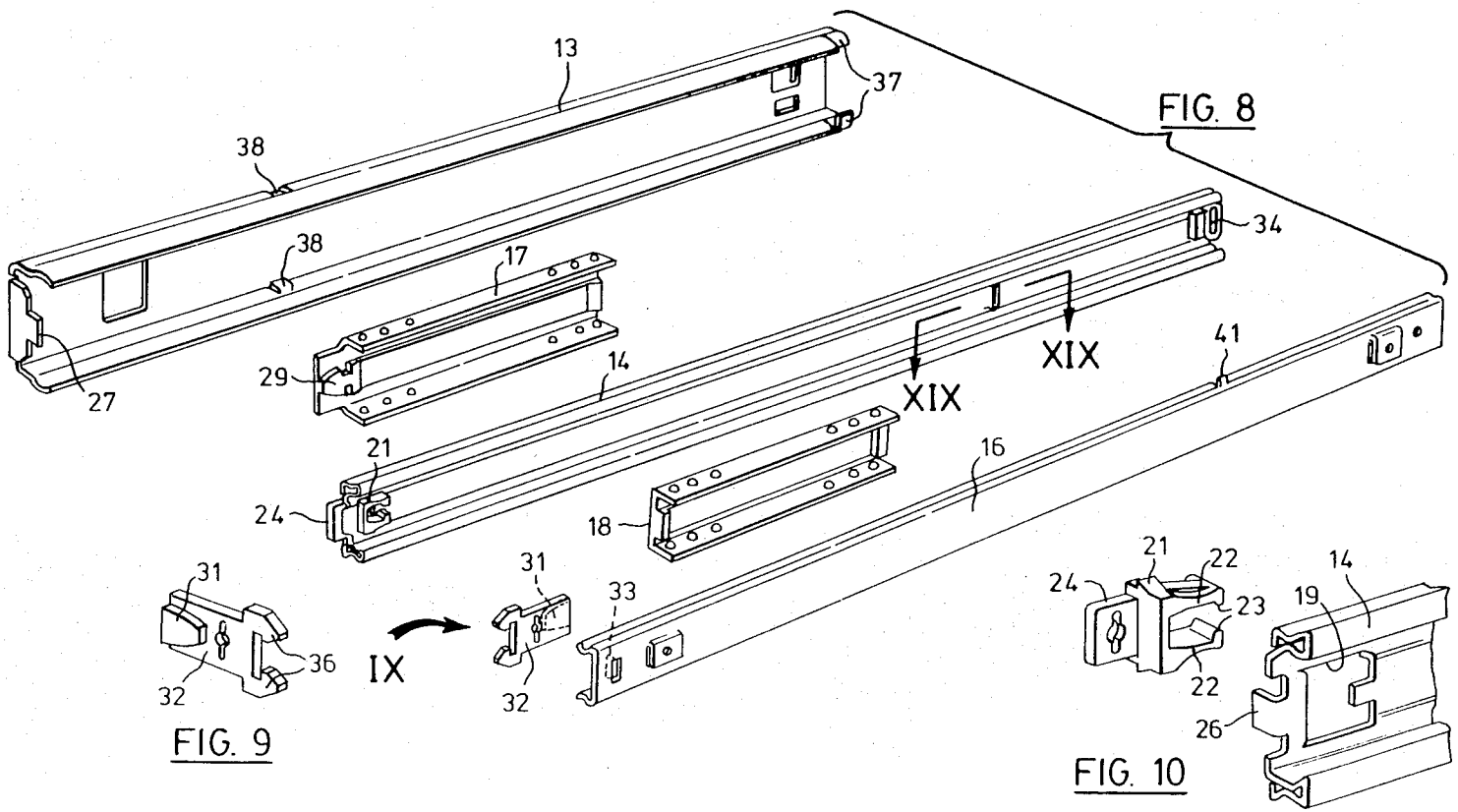
FIG. 8 is an exploded perspective view of a second form of three part slide in accordance with the invention.
FIG. 9 shows a detail of the engagement member taken on the arrow IX in FIG. 8.
FIG. 10 shows an enlarged exploded perspective view of the resilient latch member at the inner end of the intermediate rail.

Referring to FIGS. 1 to 7, an aperture 19 is formed through the intermediate rail 14 adjacent its rearward end. In this aperture is located a resilient latch member in the form of a one-piece elastomeric moulding 21 best seen in side view in FIG. 6. On the forward end of the moulding is an opening defined between two integral resilient fingers 22 that normally slope inwardly at a clearance from the sides of the aperture 19, as can be seen in FIG. 4, and that have reentrant distal portions 23. In the example illustrated, the moulding 21 includes a rearward extension 24 that abuts the outer face of the intermediate rail and is penetrated by a tab 26 struck outwardly from the rearward end of rail 14 and constituting a stop. In the retracted condition shown in FIG. 3 this tab 26 abuts a similar tab 27 struck inwardly from the rearward end of rail 13 and in the extended condition shown in FIG. 4 the tab 26 engages the rearward end ball bearing of cage 17 which in turn abuts a stop tab 28 struck inwardly adjacent the forward end of rail 13. Thus, rearward and forward movement of rail 14 relative to rail 13 is limited.

The inner face of the rearward end of cage 17 is formed with an engagement member 29 in the form of rounded arrowhead conforming to the recess defined by the resilient fingers 22 and about half the thickness of the latter.

An engagement member 31, of similar rounded arrowhead configuration and thickness, is provided on the inner side of the rearward end of rail 16. In the example illustrated, member 31 is moulded integrally with a block 32 e.g. of the same resilient elastomer as the moulding 21, and the block 32 is mounted on a tab 33 struck outwardly adjacent the rearward end of rail 16. The forward face of block 32 forms a stop that in the extended condition of the slide abuts the cage 18 and the latter in turn abuts a tab 34 struck inwardly from the forward end of rail 14. As explained in more detail hereinafter, rearward travel of rail 16 relative to rail 14 is limited by the engagement member 31 lodging in the opening in the moulding 21.

In operation, commencing with the slide in the fully retracted condition as shown in FIG. 3, the engagement member 31 is lodged in the opening in the moulding 21 between the fingers 22, so that rails 14 and 16 are latched together. On forward movement of the drawer 11 the rails 14 and 16 move together relative to rail 13 in the direction of the arrows in FIG. 5 up to the point where the forward end of cage 17 reaches stop 28 and the engagement member 29 enters the opening in the moulding 21. As the engagement member 29 enters the opening, as shown in FIGS. 6 and 7, its rounded sides act as cam surfaces so that the fingers 22 are spread outwardly in the direction of the arrows of FIG. 6 owing to the engagement of the re-entrant portions 23 on the widest part of the arrowhead, eliminating or reducing the clearance between the fingers 22 and the aperture 19. In this condition, the engagement member 31 can slip relatively easily from between the fingers 31 under the forward-acting tension applied to the drawer, so the movement of the extension is made more smooth and continuous. On returning the slide to the retracted condition, the reverse sequence of engagement of engagement member 31 in the opening and disengagement of engagement member 29 from the opening occurs as will be readily apparent and it will be noted that as the blunt arrowhead end of the engagement member 31 engages the rearward side of the opening in the moulding 21 this serves as a stop limiting rearward movement of the rail 16 when the rail 14 is in its position of maximum rearward retraction.

Figure 11:
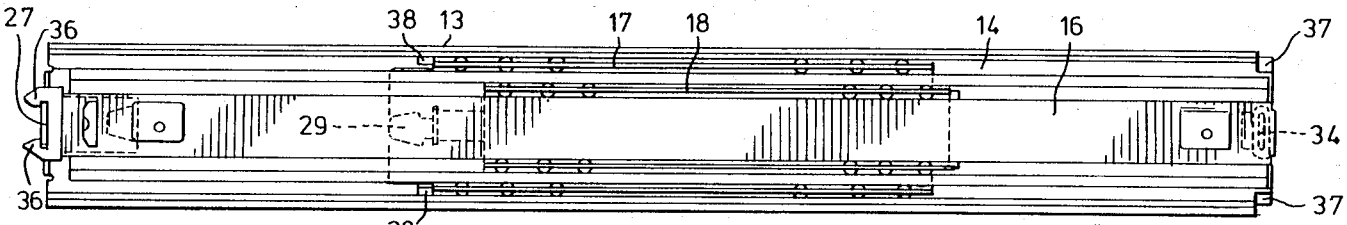
FIG. 11 is an elevational view of the slide of FIG. 8 in the retracted condition.
Figure 15:
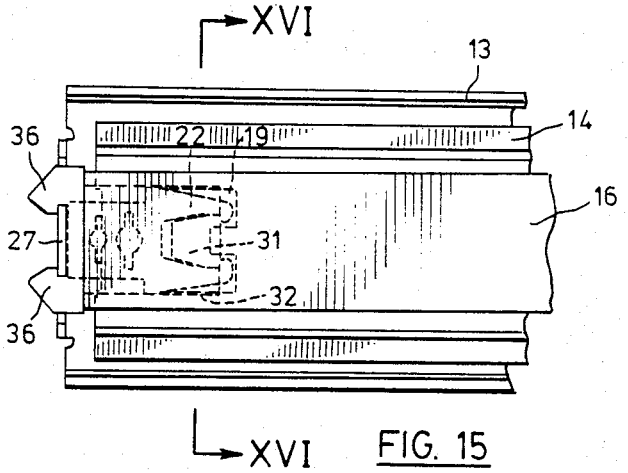
FIG. 15 shows an enlarged view of the latch member with the slide in the retracted condition.
Figure 16:
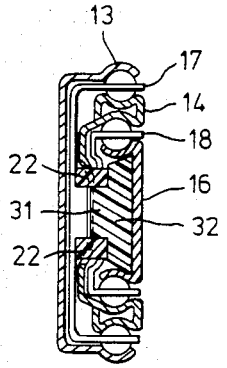
FIG. 16 shows a cross-section on the line XVI—XVI of FIG. 15.

In the embodiment shown in FIGS. 8 to 19, the rearward end of the elastomer block 31, attached on the rearward end of the inner rail 16, is formed with two rearward claw-shaped projections 36 which, when the suspension is in the closed position, as shown in FIGS. 11 and 15, grasp the tab 27 on the rear end of the outer rail 13, so as to hold the drawer closed until it is given a firm pull in the forward direction.

Figure 12:
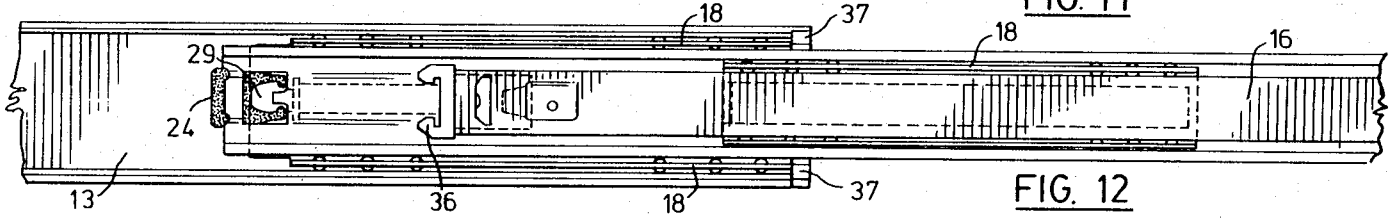
FIGS. 12 and 13 are views similar to FIG. 11 showing successive stages in the opening of the slide, FIG. 13 showing the fully extended position.
Figure 13:
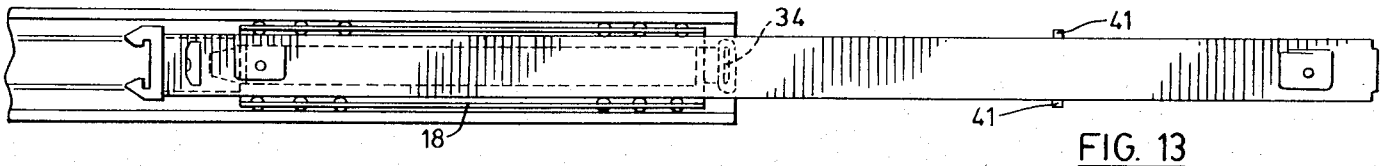
Figure 14:
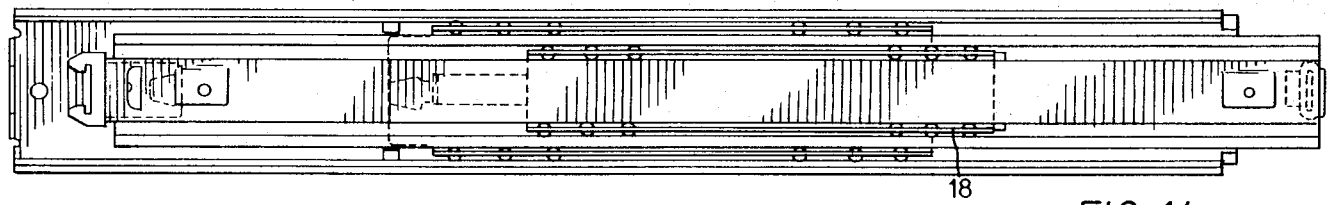
FIG. 14 shows the slide moving toward the retracted condition.
Figure 17:
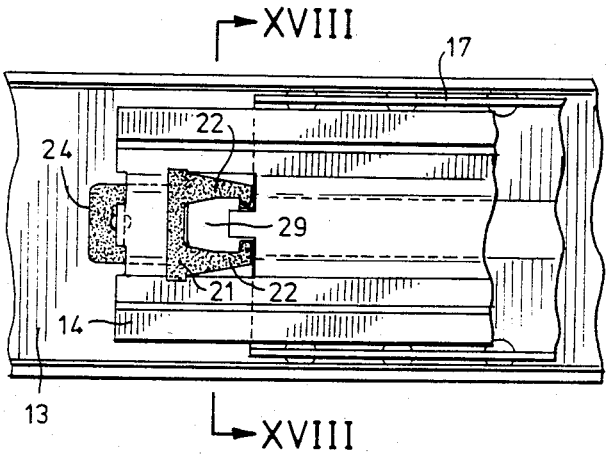
FIG. 17 shows an enlarged view of the latch member with the slide in the extended condition.
Figure 18:
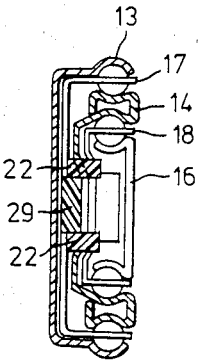
FIG. 18 shows a cross-section on the line XVIII–XVIII of FIG. 17.
Figure 19:
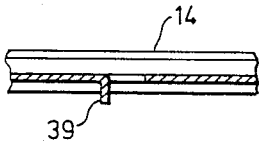
FIG. 19 shows a cross-section on the line XIX—XIX of FIG. 8.

FIGS. 12 and 17 illustrate a stage in the forward movement of the drawer subsequent to the point where the engagement member 29 has entered the opening between the fingers 22 and the engagement member 31 has been released.

The stop limiting movement of the intermediate rail 14 in this embodiment is provided by two tabs 37 at the forward end of the outer rail 13, these tabs 37 being formed by curling inwardly a portion of the channel wall of the rail 13 so that in the extended position of the rail 14 the forward edge of the outer bearing cage 17 engages on the tabs 37, as shown in FIG. 12.

It will be appreciated that for proper functioning of the latching means, it is important that the engagement member 29 should enter the opening between the fingers 22 and release the engagement member 31 simultaneously with the forward end of the bearing 18 striking the stops (28 in FIGS. 2 to 7 and 37 in FIGS. 8 to 19) that limit forward extension of the intermediate rail 14. It has however been found that when the drawer is repeatedly opened and closed a small way, i.e. without the intermediate rail 14 reaching full extension, there is sometimes a tendency for the bearing cage to creep from its proper position midway between the stop 28 or 37 and the opening 29. In order to counteract this, the embodiment shown in FIGS. 8 to 19 includes two abutment members 38 formed by striking inwards two small portions of the rail 13 adjacent the base of its channel walls. The abutment members 38 are positioned so that they engage the leading edge of the bearing cage 17 on closing movement of the drawer if the cage 17 has become displaced rearwardly, and shift it to its proper position, as shown in FIG. 11, so as to avoid premature entry of the engagement member 29 into the opening between the fingers 22 during opening of the drawer before the intermediate rail 14 has reached its fully extended position.

The intermediate rail 14 may also be provided with a further abutment member 39, formed by striking a tab outwardly from the central region of the channel, for engaging the forward end of the bearing cage 17 and shifting it rearwardly if it becomes displaced rearwardly from its proper position, and the inner rail 16 may likewise be formed with a pair of abutment members 41 formed by striking small tabs outwardly from the channel walls, for shifting the inner bearing cage 18 rearwardly to its proper position if it becomes displaced. These abutment members can serve to reduce uneveness of operation by preventing the bearing cages 17 and 18 striking their stops 37 and 34, respectively, prematurely when the drawer is opened.

It will be appreciated fromm the above that controlled, positive sequential motion of the rails on each side of the drawer can be achieved so that random interruption or checking of the motion of the slide parts on opposite sides is avoided.

In the example illustrated the outer rail, relative to which the other two rails move during initial extension, is shown adjacent the cabinet 12. It will be appreciated, however, that this slide may be inverted and the outer rail 13 may therefore be secured to the drawer 11 and the inner rail 16 to the cabinet 12.

What I claim is:

1. A three-part drawer slide comprising outer, intermediate, and inner rails, outer and inner bearings between the outer and intermediate rails and between the intermediate and inner rails, respectively, for reduced friction sliding movement of the outer rail relative to the intermediate rail and of the intermediate rail relative to the inner rail, each of said bearings comprising rolling members held in a bearing cage stop means defining a retracted condition of said rails relative to one another and an extended position of said rails relative to one another, said stop means including a stop member on one end of the intermediate rail for engaging a rear face of the outer bearing cage and a stop member on one end of the outer rail for engaging a front face of the outer bearing cage in the extended position of the intermediate rail relative to the outer rail, and said stop means further permitting the inner rail to move freely from its extended position relative to intermediate rail to is retracted position relative to the intermediate rail, first latching means for releasably latching the intermediate and inner rails together stationary relative to one another in a retracted condition of the latter relative to the former, and second latching means releasably latching the intermediate and outer rails together stationary relative to one another in said extended position of the intermediate rail relative to the outer rail having said outer bearing cage rear and front faces engaged between said stop members on the intermediate and outer rails, and said second latching means comprising a resilient latching member disengagable by applying hand pressure to the intermediate rail to retract it relative to the outer rail, and release means responsive to movement of the intermediate rail relative to the outer rail and operative to release the first latching means when the intermediate rail reaches its extended position relative to the outer rail.

2. A slide as claimed in claim 1, in which the first latching means can be released also by exerting normal hand pressure longitudinally on the inne rail in the direction tending to extend said inner rail.

3. A slide as claimed in claim 1, in which the first latching means comprise a resilient member on one of the intermediate rails and the inner rail and a first engagement member on the other of said rails, said resilient member and said engagement member being positioned to cooperate and latch together when the inner rail is in the retracted condition relative to the intermediate rail.

4. A slide as claimed in claim 3, in which the second latching means comprises a second engagement member positioned to engage latchingly with the resilient member in the extended position of the intermediate rail relative to the outer rail.

5. A slide as claimed in claim 4, in which the second engagement member comprises a cam surface that constitutes said release means, and said cam surface deflects the resilient member in the extended position of the intermediate rail and allows disengagement of the first engagement member therefrom, whereby the inner rail is freed to move relative to the intermediate rail.

6. A slide as claimed in claim 3, in which the intermediate rail is a channel-section rail and the resilient member is located in an aperture in the bottom of the channel.

7. A slide as claimed in claim 6, in which the resilient member comprises a unitary piece of resilient elastomer secured to the intermediate web.

8. A slide as claimed in claim 3, in which each rail is a channel section rail and each of said resilient members and engagement members is located centrally of the bottom of the channel section.

9. A slide as claimed in claim 8, wherein the intermediate and inner rails nest within the oute rail.

10. A three-part drawer slide comprising outer, intermediate, and inner rails, bearings between the rails for reduced friction sliding movement of the outer rail relative to the intermediate rail and of the intermediate rail relative to the inner rail, stop means defining a retracted condition of said rails relative to one another and an extended position of said rails relative to one another, first latching means for releasably latching together the intermediate and inner rails in a retracted condition of the latter relative to the former, and second latching means for releasably latching the intermediate and outer rails together in relatively extended position of the intermediate rail relative to the outer rail, and release means responsive to movement of the intermediate rail relative to the outer rail and operative to release the first latching means when the intermediate rail reaches its extended position relative to the outer rail; the first latching means comprising a resilient member on one of the intermediate rails and the inner rail and a first engagement member on the other of said rails, said resilient member and said engagement member being positioned to cooperate and latch together when the inner rail is in the retracted condition relative to the intermediate rail; the second latching means comprising a cam surface formed on a bearing cage interposed between the intermediate and outer rails and positioned to engage latchingly with the resilient member in the extended position of the intermediate rail relative to the outer rail; said cam surface constituting said release means, and deflecting the resilient member in the extended position of the intermediate rail and allowing disengagement of the first engagement member therefrom, whereby the inner rail is freed to move relative to the intermediate rail.

11. A slide as claimed in claim 10, wherein the resilient member is adjacent one end of the intermediate rail and the second engagement member is provided on one end of said bearing cage.

12. A three-part drawer slide comprising outer, intermediate, and inner rails, bearings between the rails for reduced friction sliding movement of the outer rail relative to the intermediate rail and of the intermediate rail relative to the inner rail, stop means defining a retracted condition of said rails relative to one another and an extended position of said rails relative to one another, first latching means for releasably latching together the intermediate and inner rails in a retracted condition of the latter relative to the former, and second latching means for releasably latching the intermediate and outer rails together in relatively extended position of the intermediate rail relative to the outer rail, and release means responsive to movement of the intermediate rail relative to the outer rail and operative to release the first latching means when the intermediate rail reaches its extended position relative to the outer rail; the first latching means comprise a resilient member on one of the intermediate rails and the inner rail and a first engagement member on the other of said rails, the resilient member and the engagement member being positioned to cooperate and latch together when the inner rail is in the retracted condition relative to the intermediate rail; and the resilient member comprising a pair of resilient fingers receiving the first engagement member therebetween in the retracted condition of the inner rail relative to the intermediate rail.

* * * * *